United States Patent [19]

Abbott et al.

[11] 4,284,701

[45] Aug. 18, 1981

[54] ELECTROPHOTOGRAPHIC TONER OF SPECIFIC SIZE DISTRIBUTION

[75] Inventors: Jerry J. Abbott, Longmont; Sterritt R. Fuller, Boulder; Paul D. Jachimiak, Lafayette, all of Colo.

[73] Assignee: International Business Machines Corporation, Armonk, N.Y.

[21] Appl. No.: 183,701

[22] Filed: Sep. 3, 1980

Related U.S. Application Data

[63] Continuation of Ser. No. 848,173, Nov. 3, 1977.

[51] Int. Cl.[3] ..... G03G 9/08

[52] U.S. Cl. ..... 430/111; 430/121

[58] Field of Search ..... 430/111, 121

[56] References Cited

U.S. PATENT DOCUMENTS

| | | | |
|---|---|---|---|
| 3,262,806 | 7/1966 | Gourge | 430/103 |
| 3,586,654 | 6/1971 | Lerman et al. | 430/111 X |
| 3,674,736 | 7/1974 | Lerman et al. | 430/111 X |
| 3,910,846 | 10/1975 | Azar | 430/137 |
| 3,989,648 | 11/1976 | Lenhard | 430/106 |
| 4,122,024 | 10/1978 | Jones et al. | 430/111 |

FOREIGN PATENT DOCUMENTS 2522771 12/1975 Fed. Rep. of Germany .

OTHER PUBLICATIONS

Xerox Disclosure Bul. #5, vol. 2, (9-10/1977).

*Primary Examiner*—John D. Welsh
*Attorney, Agent, or Firm*—Francis A. Sirr

[57] ABSTRACT

A toner material for use in developing images in an electrostatographic device is disclosed. The toner particles are initially classified according to a size distribution wherein less than 15% by weight are greater than 16 microns, between 7 and 15% by weight are less than 5 microns the remainder being from 5 to 16 microns and wherein the median particle size by weight is from 8 to 12 microns. The toner is used in a developer mix with carrier particles, and preferably the toner carrier mix is equilibrated such that the action of the developer mix and the machine provide a toner particle size distribution wherein less than 12% by weight are greater than 16 microns, between 15 and 30% by weight are less than 5 microns, the remainder being from 5 to 16 microns, and wherein the median particle size by weight is between 6.5 and 9.5 microns. An equilibrated toner particle distribution is also disclosed.

11 Claims, No Drawings

ELECTROPHOTOGRAPHIC TONER OF SPECIFIC SIZE DISTRIBUTION

This is a continuation of application Ser. No. 848,173 filed Nov. 3, 1977.

BACKGROUND OF THE INVENTION

This invention relates generally to size classified small particles, and more specifically to size classification of electrostatographic toner particles, and their use admixed with carrier particles in the electrophotographic copying process.

In electrophotography, a photoconductor is charged and then exposed imagewise to light. In the area of the photoconductor exposed to light, the charge dissipates or decays while the dark areas retain the electrostatic charge.

The difference in the charge levels between the areas exposed to light and the dark areas produces electrical fields therebetween. Thereafter, the resultant latent electrostatic image on the photoconductor is developed by depositing small colored particles, which are known as toner particles, having a charge so as to be directed by the electrical fields to the image areas of the photoconductor to develop the electrostatic image.

A number of means are known for developing the latent electrostatic image by the application of the toner particles. One of these is known as cascade development and is described in U.S. Pat. No. 2,638,552 to Wise. Another means is known as the magnetic brush process. This method is described in U.S. Pat. No. 2,874,063 to Greig.

In each of the cascade and magnetic brush development processes, a two component developer material is utilized. The developer material comprises a mixture of small toner particles and relatively large carrier particles. The toner particles are held on the surfaces of the relatively large carrier particles by electrostatic forces which develop from the contact between the toner and carrier particles producing triboelectric charging of the toner and the carrier to opposite polarities. When the developer material is moved into contact with the latent electrostatic image of the photoconductor, the toner particles are attracted to the latent image.

The toner and carrier particles of the developer material are specially made and processed to that the toner obtains the correct charge polarity and magnitude of charge to insure that the toner particles are preferentially attracted to the desired image areas of the photoconductor. The toner particles are then transferred electrostatically to the desired copy sheet, after which the transferred image of toner particles is fused by heat and/or pressure to produce the final product of a fused copy of the desired image.

One of the problems encountered is to provide the best possible quality of a final image on the copy sheet. This is generally referred to as copy quality. Copy quality includes such things as image clarity, i.e., clear delineation of lines; uniform darkness of the image areas; background quality, i.e., grayness or lack of it in the background areas; and other somewhat intangible features that go toward making a good "quality" copy.

Other factors that merit consideration in the developing process vis-a-vis toner is the overall utilization of toner per copy. Of course from an economic point of view the less toner used per any given image the better. Also in a system in which unused toner is cleaned from the air by use of a filter, it is important to minimize the amount of unused toner to thereby extend the life of the filter.

Further, when heat fusing is used it is desirable to provide an image that will have the best possible heat transfer characteristics to minimize the amount of heat needed to fuse the image. This is important not only from an energy point of view, but also with more rapid heat transfer by the toner, the fusing time or temperature can be reduced.

All of these factors play important roles in developing an optimum toner particle.

One of the principal contributing characteristics of the toner particles in achieving optimum results in the above-noted areas in the size and size distribution of the toner particles. This fact in itself is well known, and there have been several prior art proposals for various systems of toner particle classification.

U.S. Pat. No. 3,674,736 to Lerman et al discloses pigmented polymer particles suitable "for use as toner . . . and as developers for electrostatic process," and the method of making such toners. This patent claims material having an average particle diameter within the range of from about 1 to 30 microns (NMD) and a GSD of less than about 1.5. By extrapolation and the use of Gaussian distribution this can be related to a particular size distribution.

German Offenlegungsschrift No. 2,522,771 (unexamined published patent application) filed May 22, 1975 and published Dec. 11, 1975 assigned to Xerox, discloses toner particles which essentially have the same distribution as those of the Sherman et al patent. This German reference discloses toner with a size distribution by number or population wherein less than 30% of the particles are less than 5 microns, about 25% are between 8 and 12 microns, and less than 5% are greater than about 20 microns. This German reference also discloses a fine index ratio of less than about 2.50 and a coarse index ratio of less than about 1.50.

SUMMARY OF THE INVENTION

According to the present invention, a size classified toner material is provided which has a particle size distribution as follows:

less than 15% by weight are greater than 16 microns, from 7 to 15% by weight are less than 5 microns, the remainder are from 5 to 16 microns, the median particle size by weight being from 8 to 12 microns.

The toner particles are mixed with carrier particles to form a developer for use in an electrostatic copying process. The toner as used in a magnetic brush type developer in the presence of carrier while running against the photoconductor surface, will result in equilibration of the toner particle size distribution and will preferably generate the following size distribution:

| | |
|---|---|
| Median by weight | 6.5–9.5μ |
| % by weight <5μ | 15.0–30.0% |
| % by weight >16μ | <12.0% |

In even more particular aspects the size distribution of the particles of the original toner is as follows:

less than 2% by weight are greater than 16 microns, between 9 and 15% by weight are less than 5 microns, the remainder are from 5 to 16 microns, the average particle size being from 8.5 to 9.5 microns.

DESCRIPTION OF THE PREFERRED EMBODIMENTS

It has been found that by utilizing toner classified according to this invention, greatly improved results are realized as compared to conventional toner in the areas of copy quality, filter life, toner utilization, and fusing quality. Standard or conventional toner, as exemplified by that used in IBM Series III Copier/Duplicator is classified as follows:

0.8%±0.4% by weight less than 5 microns, about 35% by weight greater than 16 microns, less than 0.5% by weight greater than 32 microns, the median particle size by weight being 13.6±0.6 microns. In measuring size distribution a Coulter counter is utilized in a conventional manner.

In order to compare toners, examples of various toners are prepared with size distribution as shown in Table I.

TABLE I

| | Example I | Example II | Example III |
|---|---|---|---|
| Median Particle Size by Weight | 13.5μ | 11.0μ | 8.5μ |
| Percent by Weight Less Than 5μ | .8% | 7.1% | 11.8% |
| Percent by Weight Greater Than 16μ | 30.0% | 15.0% | 1.0% |

Each of the toners was formulated of a mixed resin system which is used for toner in the IBM Series III Copier. Example I is representative of conventional prior art toner, and Examples II and III are examples of toner according to this invention.

About one part by weight of toner of each of the examples was mixed with about 99 parts by weight of a conventional carrier, formed of a coating of PTFE on steel shot, formed according to the teaching of U.S. Pat. No. 3,947,271. Each mixture was placed in a conventional copy machine, of a type commercially available, known as IBM Series III Copier/Duplicator, and copies were made. Toner was added to each mixture to maintain an essentially constant toner concentration. The toner/carrier mix was run 10,000 copies to bring the toner particle size in the mix to equilibrium. This equilibration of the toner particle size results from the action of the toner, carrier, and photoconductor during machine operations and actually alters the particle size until it reaches essentially an "equilibrium" point, at a relatively constant toner concentration, after which the size distribution will remain essentially constant. This break-in or equilibration of the toner is desirable, since it provides more uniform copy quality than a developer which has only the initially sized toner distribution. Furthermore, the copy quality achieved with an equilibrated bin mix is more representative of machine performance than an unequilibrated mix. The equilibrated values for each example are shown in Table II below.

TABLE II

| | Example I | Example II | Example III |
|---|---|---|---|
| Median Particle Size by Weight | 11.0μ | 9.0μ | 7.0μ |
| Percent by Weight Less Than 5μ | 14.0% | 17.0% | 28.0% |
| Percent by Weight Greater Than 16μ | 24.0% | 11.0% | 1.0% |

Following the break-in period, additional copies were run to test the copy quality. The following tests were performed to determine the copy quality, and performance of the toner.

BACKGROUND QUALITY

The background quality of the copies was measured with an S-4 Brightness Tester and Colorimeter manufactured by Diano Corporation. This unit is used to measure the reflectance of a surface. Results are reported as the percent of change in reflectance of the paper before and after making a copy. Generally a background measurement resulting from a change in the reflectance of the paper of more than about 1.5% is objectionable, and is unacceptable copy quality due to high background.

RECYCLE RATE

The copy machine is equipped with a filter to clean the recycled toner. This is a physical cleaning device, and the life of the device is inversely proportional to the recycle rate. In other words, the lower the recycle rate the better the toner performance. Recycled toner is that which was deposited onto the photoconductor but not transferred to the copy sheet.

TONER YIELD

Toner yield is the number of copies made at a given optical density per pound of toner used.

OPTICAL DENSITY

Optical density is the measurement of the "solidness" or "fill" of the image lines on the copy sheet after fusing.

FUSED QUALITY OF OFFSET MASTER

Offset master papers are a difficult substrate on which to fuse toner. The fuse quality test for offset master papers consists of making copy on offset master paper and then judging qualitatively the adhesion of the toner image to the substrate.

Table III below summarizes the results of the optical density, background quality, recycle rate, toner yield, and fuse quality tests which were performed on copies made while using toner described in the three above examples.

TABLE III

| | Example I | Example II | Example III |
|---|---|---|---|
| Optical Density | 00.95 | 01.15 | 01.15 |
| Background | 01.20 | 00.90 | 00.90 |
| Recycle Rate (mg/copy) | 30.00 | 22.00 | 14.00 |
| Toner Yield (copies/lb) | 14.000 | 17.000 | 25.000 |
| Fuse Quality of Offset Master | Unacceptable | Acceptable | Superior |

It can be seen from the table above that Example III is by far the best toner, Example II is the next best and Example I is the worst. It will be noted that even Example II which is at the limits of the ranges of the invention is a significant improvement over the prior art toner as exemplified in Example I. Indeed the background is significantly less, there is substantially less toner recycled, a higher yield of copies per pound of toner is obtained, and the toner forms an acceptable offset master whereas the toner of Example I does not. These benefits are even more improved with the toner of Example III.

These results show that toner, as initially added or utilized in a developer mix should have a size distribution wherein less than 15% by weight are greater than 16 microns in size, between 7 and 15% are less than 5 microns in size, the remainder being from 5 to 16 microns in size and wherein the median size by weight is from 8 to 12 microns. More preferably the size distribution should be less than 2% by weight being greater than 16 microns, between 9 and 15% by weight being less than 5 microns, the remainder being from 5 to 16 microns, with the median size by weight being from 8.5 to 9.5 microns. These size distributions relate to the size distribution of fresh and unused toner. The equilibrated size distribution after break-in should be as follows:

| | |
|---|---|
| Median by weight | 06.5–09.5μ |
| % by weight <5μ | 15.0–30.0 |
| % by weight >16μ | 12.0 |

The reasons for such improvement are not all completely understood, but it is believed that the following factors contribute significantly.

Reflection is a measurement which indicates background quality and the unaided eye can see particles on the background. By reducing the number of particles greater than 16μ, the number of particles which are observable to the unaided eye is reduced significantly, thus producing a better background appearance.

The recycle rate is believed to be reduced in the following manner: Since there are fewer large particles, and the particles are more nearly equal in size, the particles will receive more nearly equal electrostatic charges. Large particles have lower charge-to-mass ratios and are less responsive to force fields in development and transfer; hence, they tend not to adhere as readily, and thus will more readily be removed and recycled. Further, it is known that large particles have a greater tendency to dust onto the background area because of their low charge-to-mass ratio. Therefore the lower the number of particles greater then 16μ the lower the recycle rate will be.

With respect to more efficient toner utilization, copy is made "black" by the application of a layer of toner particles which is held by electrostatic attraction. The depth of the layer plays no part in the "blackness" of the copy as long as the area of the substrate covered is equivalent. Thus, one can use a layer of "thinner" particles, rather than "thicker" particles, and therefore the weight or volume of toner used to produce an image on the substrate will be less per layer of particles. By reducing the number of particles greater than 16 microns in size, the weight of particles per layer will be reduced, and will thus result in increasing the number of copies per pound of toner.

With respect to fuse quality of offset printing masters, the quality of the printing is greatly improved with toner of the present invention. It is believed that this is related to better heat transfer characteristics. It is theorized that the thinner layers of the particles of the present invention will provide a shorter heat path than the thicker particles of the prior art. This will improve the fuse quality characteristics of the toner and will result in better adhesion of the toner to the substrate. This property is also significant with other substrates, allowing more rapid fusing than that which is achievable with thicker layers of toner particles.

It has been found that within the narrow limits, outstanding copy quality is obtained, having marked improvement over conventional prior art toner and excellent toner utilization is obtained. However, as the broadest limits are approached, especially as the number of particles larger than 16 microns in size approaches the upper limits, the copy quality improvement over conventional particle size distributions becomes less significant. Even so, within the broad limits, substantially improved toner is achieved. Within the narrow limits, and especially with the number of particles of greater than 16 microns in size being less than 2%, outstanding copy quality is obtained.

While the invention has been particularly shown and described with reference to preferred embodiments thereof, it will be understood by those skilled in the art that various changes in form and details may be made therein without departing from the spirit and scope of the invention.

What is claimed is:

1. An electrostatographic toner material comprising particles having the following size distributions:

less than 15% by weight being greater than 16 microns in size, from 7 to 15% by weight being less than 5 microns in size, the remainder being from 5 to 16 microns in size, the particle median size by weight being from 8 to 12 microns.

2. An electrostatographic toner material according to claim 1 wherein less than 2% by weight are greater than 16 microns in size, from 9 to 15% by weight are less than 5 microns in size, the median particle size by weight being from 8.5 to 9.5 microns.

3. An electrostatographic toner according to claim 1 wherein the median particle size by weight is between 8.5 and 9.5 microns.

4. An electrostatographic toner according to claim 1 wherein there is less than 2% by weight of particles greater than 16 microns.

5. An electrostatographic toner according to claim 1 wherein from 9 to 15% by weight are less than 5 microns.

6. A developer mix for electrostatographic copying comprising toner particles and carrier particles of opposite triboelectric charges, said toner particles having the following size distribution:

less than 15% by weight being greater than 16 microns in size, from 7 to 15% by weight being less than 5 microns, the remainder being from 5 to 16 microns, the median particle size by weight being from 8 to 12 microns.

7. A developer mix according to claim 6 wherein the toner particle size distribution is less than 2% by weight greater than 16 microns, from 9 to 15% by weight less than 5 microns, the median particle size by weight being from 8.5 to 9.5 microns.

8. A developer mix according to claim 6 wherein the median toner particle size by weight is between 8.5 to 9.5 microns.

9. A developer mix according to claim 6 wherein there is less than 2% by weight of toner particles greater than 16 microns.

10. A developer mix according to claim 6 wherein there is from 9 to 15% by weight of toner particles less than 5 microns.

11. In an electrostatic developing process, wherein a mix of toner and carrier particles are provided and applied to a photoconductor to develop a latent electrostatic image thereon, and wherein the developed image is transferred to a copy sheet, the improvement which comprises, maintaining a developer mix having toner particles therein equilibrated to the following size distribution;

less than 12% by weight greater than 16 microns, from 15 to 30% by weight less than 5 microns, the remainder from 5 to 16 microns, the median toner particle size by weight being between 6.5 and 9.5 microns.

* * * * *

UNITED STATES PATENT AND TRADEMARK OFFICE

CERTIFICATE OF CORRECTION

PATENT NO. : 4,284,701

DATED : Aug. 18, 1981

INVENTOR(S) : Jerry J. Abbott, Sterritt R. Fuller, Paul D. Jachimiak

It is certified that error appears in the above—identified patent and that said Letters Patent is hereby corrected as shown below:

Col. 2, line 15, delete "in" and insert --is--.

Signed and Sealed this

*Third* Day of *November 1981*

[SEAL]

*Attest:*

GERALD J. MOSSINGHOFF

*Attesting Officer*

*Commissioner of Patents and Trademarks*